US010138427B2

(12) United States Patent
Lupinsky et al.

(10) Patent No.: US 10,138,427 B2
(45) Date of Patent: Nov. 27, 2018

(54) SEPARATION OF HYDROCARBONS FROM PARTICULATE MATTER USING SALT AND POLYMER

(71) Applicant: EXTRAKT PROCESS SOLUTIONS, LLC, Bowling Green, KY (US)

(72) Inventors: Aron Lupinsky, Boalsburg, PA (US); Bruce G. Miller, Boalsburg, PA (US); Paul C. Painter, Boalsburg, PA (US)

(73) Assignee: EXTRAKT PROCESS SOLUTIONS, LLC, Bowling Green, KY (US)

( * ) Notice: Subject to any disclaimer, the term of this patent is extended or adjusted under 35 U.S.C. 154(b) by 0 days.

(21) Appl. No.: 15/457,029

(22) Filed: Mar. 13, 2017

(65) Prior Publication Data

US 2017/0369788 A1 Dec. 28, 2017

Related U.S. Application Data

(60) Provisional application No. 62/353,287, filed on Jun. 22, 2016.

(51) Int. Cl.
*C10G 1/04* (2006.01)

(52) U.S. Cl.
CPC ..... *C10G 1/045* (2013.01); *C10G 2300/802* (2013.01)

(58) Field of Classification Search
CPC ..... C10G 1/045; C10G 2300/802
See application file for complete search history.

(56) References Cited

U.S. PATENT DOCUMENTS 4,046,668 A 9/1977 Farcasiu et al.
4,250,016 A 2/1981 Estes et al.
4,270,609 A * 6/1981 Choules ..... C10C 3/007 166/272.3
4,444,260 A 4/1984 Boyd et al.
4,693,830 A 9/1987 Thornton et al.
4,765,910 A 8/1988 Wolf
4,948,393 A 8/1990 Hodson et al.
5,447,638 A 9/1995 Holdar et al.
5,458,198 A 10/1995 Hashemi et al.
5,882,524 A 3/1999 Storey et al.
5,968,349 A 10/1999 Duyvesteyn et al.
6,315,837 B1 11/2001 Barclay
6,550,552 B1 4/2003 Pappa et al.
(Continued)

FOREIGN PATENT DOCUMENTS

CA 2797513 A1 11/2011
CA 2833353 A1 11/2011

OTHER PUBLICATIONS

P. Painter et al., "Recovery of Bitumen from Oil or Tar Sands Using Ionic Liquid," Energy Fuels, 2010:24:1094-1098.
(Continued)

*Primary Examiner* — Randy Boyer
*Assistant Examiner* — Juan C Valencia
(74) *Attorney, Agent, or Firm* — McDermott Will & Emery LLP

(57) ABSTRACT

Separating hydrocarbon from compositions including hydrocarbon and solids such as oil sands, oil sands by products, asphalt compositions, etc. includes treating such compositions with a mixture including a water soluble salt, polymer flocculent and organic diluent. The hydrocarbon separated can be in high yields and with a low solid fines content.

20 Claims, 8 Drawing Sheets

(56) References Cited

U.S. PATENT DOCUMENTS

| | | | | |
|---|---|---|---|---|
| 8,603,326 | B2 | 12/2013 | Painter et al. | |
| 8,603,327 | B2 | 12/2013 | Painter et al. | |
| 2005/0194292 | A1* | 9/2005 | Beetge | C10G 1/047 208/391 |
| 2006/0196812 | A1* | 9/2006 | Beetge | C10G 1/045 208/435 |
| 2008/0251418 | A1 | 10/2008 | Francisco et al. | |
| 2010/0258477 | A1 | 10/2010 | Kukkonen et al. | |
| 2013/0056395 | A1 | 3/2013 | Pierre, Jr. et al. | |
| 2013/0256092 | A1 | 10/2013 | Podlipskiy | |

OTHER PUBLICATIONS

P. Williams et al., "Recovery of Bitumen from Low-Grade Oil Sands Using Ionic Liquid," Energy Fuels 2010:24:2172-2173.

C.G. Hogshead et al., "Studies of bitumen-silic and oil-silica Interactions in Ionic Liquids," Energy Fuels 2011:25:293-299.

P. Painter et al., "Recovery of Bitumen from Utah Tar Sands Using Ionic Liquid," Energy Fuels, 2010:24:5081-88.

International Search Report issued in PCT/US2017/038682, dated Sep. 29, 2017.

* cited by examiner

Water 10% $NH_4Cl$ 25% $NH_4Cl$ 10% NaCl 25% NaCl

COS-1 COS-2 COS-3 COS-4 COS-5

1% Salt 0.1% PAM 1% Salt 0.1% PAM 1% Salt 0.05% PAM 1% Salt 0.01% PAM

SEPARATION OF HYDROCARBONS FROM PARTICULATE MATTER USING SALT AND POLYMER

CROSS-REFERENCE TO RELATED APPLICATION

This application claims the benefit of U.S. Provisional Application No. 62/353,287 filed Jun. 22, 2016 the entire disclosure of which is hereby incorporated by reference herein.

TECHNICAL FIELD

The present disclosure relates to separating and recovering hydrocarbons, e.g., bitumen and oil, from compositions including such hydrocarbons and solids. Such hydrocarbon compositions include, for example, oil sands, bitumen froth, pitch materials, hydrocarbon contaminated rock, soil, etc.

BACKGROUND

The separation and extraction of oil and bitumen from soil, sand, or other forms of mineral matter is a difficult and expensive process. For example, the commercial processes presently used to extract bitumen from Canadian oil sands involve crushing oil sand ore and combining it with hot or warm water and chemical aids such as sodium hydroxide (NaOH) to form a slurry. The chemical aids together with the mechanical action of transporting the slurry through a hydrotransport pipeline help to detach bitumen from the oil sand particles. The conditioned slurry is then discharged into separation cells and bitumen is separated from water by aeration to form a bitumen containing froth that can be skimmed off the surface of the water. Such commercial processes require a large amount of energy and result in the generation of significant quantities of tailings and waste process water. The need for large amounts of water is one of the reasons that U.S. reserves of tar sands (estimated to be 32 billion barrels of oil) have not been commercially developed. Energy and environmental concerns also bedevil the separation of oil or tar from the contaminated sand that is a result of conventional drilling operations (e.g., oil coated drill cuttings) or some of the newer technologies used to extract heavy oil, such as steam assisted gravity drainage (SAGD).

Because of the environmental concerns posed by warm water based extractions, work on solvent extraction of oil sands was studied. Solvent extraction methods, however, tend to produce bitumen with an excess amount of mineral fines, e.g., greater than 1%. Separated bitumen having an excess amount of mineral fines content require additional processing steps to reduce the mineral fines content to an acceptable level. In addition, solvent extraction methods require that residual solvent be recovered from the extracted sand.

The treatment and disposal of oil or bitumen contaminated sand and soil is a major problem after oil spills, either accidental, as in the Exxon Valdez or Deepwater Horizon incidents, or as a deliberate act of war, as in Kuwait. In addition, oily sludge (a mixture of heavy oil, mineral fines and water) is formed in storage tanks and supertankers and presents not only a major disposal problem, but also a significant loss of crude oil. It has been estimated that 1% 3% of the world's petroleum production is lost in the form of sludge and other wastes.

A number of treatment options can be applied to oil contaminated sand and rocks, including incineration, distillation, washing with detergents, extraction using organic solvents or bioremediation. Some of these methods have proved to be uneconomic because of their energy requirements, others do not completely remove the oil from the sand, or the chemicals used may pose unacceptable environmental concerns. None of these methods appear to be entirely satisfactory, but long-term storage (e.g., in landfills) of oil-contaminated sand is also a major problem.

The preferred solution would be to recover the oil for its economic value while generating sand in a clean form so that it can be used to repair environmental scars. This is not easy, because at least for waste materials the oil has usually weathered, lost much of its volatile component and is in the form of a viscous sludge or tar balls.

Hence there is a continuing need to develop technology that can economically separate hydrocarbons from inorganic solids including compositions of oil sands and hydrocarbon-solids compositions in good yields with minimal fines and with an improved impact on the environment.

SUMMARY OF THE DISCLOSURE

An advantage of the present disclosure is a process to separate hydrocarbons from compositions including such hydrocarbons intermixed with solids in high yields and in which the separated hydrocarbons contain a low amount of fines or mineral content.

These and other advantages are satisfied, at least in part, by a process for separating hydrocarbon from a composition comprising hydrocarbon and solids. The process comprises treating the composition with an aqueous mixture including at least one highly water soluble salt, at least one polymer flocculent and at least one organic diluent to separate the hydrocarbon from the composition. Advantageously, such an extraction mixture can separate the hydrocarbon from the composition in high yields, e.g., at least about 80%, such as at least about 85% or about 90% or higher, of the hydrocarbon included in the composition. The separated hydrocarbons can advantageously contain a low amount of fines and/or minerals, e.g., less than about 1 wt % or no more than about 0.5 wt % or no more than about 0.1 wt %.

Embodiments include one or more of the following features individually or combined. For example, in some embodiments, the composition can include a significant amount by weight of fines. In other embodiments, the at least one highly water soluble salt is an ammonium based salt such as an ammonium chloride, ammonium sulfate or combinations thereof. In still further embodiments, the treated composition can have a salt-composition concentration of the highly water soluble salt(s) of at least 0.5 wt % and/or a polymer-composition concentration of the polymer flocculent(s) of no less than about 0.005 wt %.

Additional advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent similar elements throughout and wherein.

DETAILED DESCRIPTION OF THE DISCLOSURE

Figure 1:
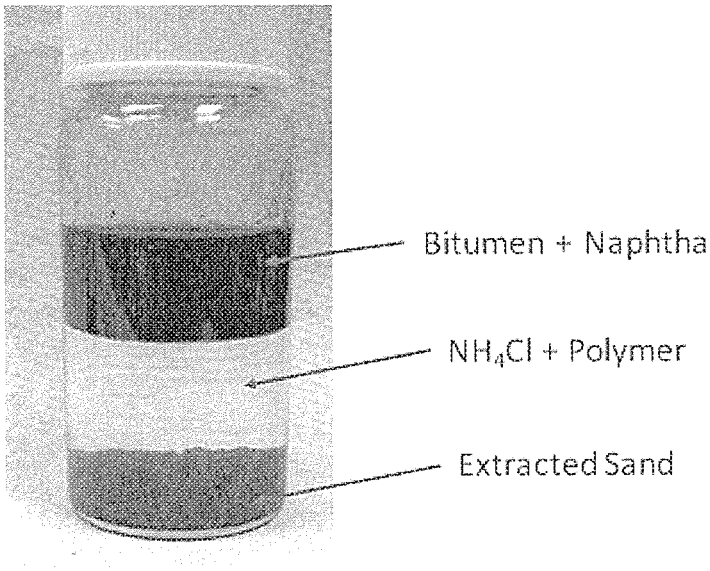
FIG. 1 is a picture of a vial showing bitumen separated from Kentucky oil sands by a separating mixture according to an embodiment of the present disclosure.

The present disclosure relates to separating hydrocarbon from compositions including the hydrocarbon intermixed with or attached to inorganic solids. Typically such hydrocarbon compositions also include water, either in their native form or added during processing of the hydrocarbon compositions. The inorganic solids include, for example, rock, sand, mineral matter, e.g., minerals and mineral like materials such as clays, and silt, hereinafter referred to as solids. Hydrocarbon compositions that can be separated according to the processes of the present disclosure include oil sands, bitumen froth, or hydrocarbon containing by products of oil sands production, asphalt compositions and pitch materials and other natural and non-natural asphalt containing compositions, hydrocarbon contaminated solids such as hydrocarbon contaminated sand, such as in Kuwait, hydrocarbon contaminated rock, soil, hydrocarbon waste products containing solids such as oily sludge etc. The hydrocarbons can include tar, crude oil, heavy oil, or other hydrocarbon oil, bitumen, asphaltenes, etc.

In practicing an aspect of the present disclosure, the process includes treating, by mixing, combining, contacting, etc., a composition comprising hydrocarbon and solids with an aqueous mixture including at least one highly water soluble salt, at least one water soluble polymer, e.g., a polymer flocculent, and at least one organic diluent to separate the hydrocarbon from the composition. Such a treated composition can form multiple phases including a hydrocarbon phase, an aqueous phase and an aggregated solids phase. The hydrocarbon phase would include the organic diluent, while the aqueous phase would include aqueous components.

We have found that a separating fluid including water and the salt(s), polymer(s) and organic diluent(s) can separate hydrocarbon from hydrocarbon compositions in high yields e.g., at least about 80%, such as at least about 85% or about 90% or higher, of the hydrocarbon included in the composition. All percentages used herein are by weight unless specified otherwise. It is believed that the highly water soluble salt(s) in the separating fluid facilitate extraction in a number of ways, including: reducing the attraction between hydrocarbons and mineral surfaces. The highly water soluble salt(s) aid in aggregating solids in the compositions, particularly fine solids which can be difficult to aggregate. It is believed the polymer acts in concert with the salt(s) to sequester solids, particularly fines, and to minimize emulsion formation in the treated composition. The organic diluent(s) aid in separating the hydrocarbon and lowers the viscosity of viscous hydrocarbons separated from the composition, which aids in recovering the hydrocarbons.

The terms coagulation and flocculation are often used interchangeably in the literature. As used herein, however, coagulation means particle aggregation brought about by the addition of salts, whereas flocculation means particle aggregation induced by flocculating polymers. Aggregation induced by the addition of salts is believed to be the result of destabilizing the particles suspended in the fluid by an alteration or a shielding of the surface electrical charge of the particles to reduce the inter-particle repulsive forces that prevent aggregation, whereas aggregation induced by flocculation is believed to be the result of the polymer binding to the particles thereby tying the particles together into a so called floc causing aggregation of the particles.

Hydrocarbon separated from the treated composition can then be recovered from the treated composition by any number of processes useful for recovering hydrocarbon separated from solids and an aqueous mixture such as by skimming, decanting, distilling, centrifuging, etc. using such devices such as decanters, distillation columns, pressure separators, centrifuges, open tank, hydrocyclones, settling chambers or other separators, etc.

Advantageously, the hydrocarbon separated from the composition can contain a low amount of fines. The term fines as used herein is consistent with the Canadian oil sands classification system and means solid particles with sizes equal to or less than 44 microns (μm). Sand is considered solid particles with sizes greater than 44 μm. Many of the hydrocarbon compositions that can be treated according to the present disclosure include a significant amount by weight (>5%) of fine solids. For example, oil sands deposits include approximately 10-30 wt % of solids as fines. Such fines are typically in the form of minerals or mineral like materials and recovered hydrocarbon with a high minerals content can be problematic in processes involving subsequent refining or upgrading of recovered hydrocarbon since the minerals interfere with such processes.

In certain implementations of processes of the present disclosure, compositions which have a significant amount by weight of solids as fines (>5%) are treated. Such compositions can be treated with an aqueous mixture including at least one highly water soluble salt, at least one polymer flocculent, and at least one organic diluent to separate the hydrocarbon from the composition. Advantageously, the hydrocarbon separated from the composition can contain a low amount of fines or has low minerals content, e.g., less than about 1 wt % or no more than about 0.5 wt % or no more than about 0.1 wt %. The determination of fines content can be assessed by detecting for mineral matter content in the separated hydrocarbon by infrared spectroscopy, x-ray diffraction, ash content or by an equivalent method.

Salts that are useful in practicing processes of the present disclosure include salts that are highly soluble in water. A highly water soluble salt as used herein is one that has a solubility in water of greater than 2 g of salt per 100 g of water (i.e., a salt/water solubility of 2 g/100 g) at 20° C. Preferably the highly water soluble salt has a water solubility of at least about 5 g/100 g at 20° C., e.g., at least about 10 g/100 g of salt/water at 20° C.

In addition, the highly water soluble salts used in the processes of the present disclosure are preferably non-hydrolyzing. Hydrolyzing salts undergo hydrolysis when added to water to form metal hydroxides, which precipitate from solution. Such hydrolyzing salts are believed to form open flocs with inferior solids content and cannot be readily recycled for use with additional hydrocarbon compositions in continuous or semi-continuous processes. In addition, hydrolyzing salts typically have low solubility in water and are used at elevated temperatures to ensure sufficient solubility for aggregation, which is an energy intensive process.

Further, the highly water soluble salts are preferably not ionic liquids (i.e., salts having a melting point below 100° C.). Ionic liquids can be expensive and may need to be reduced to low levels on the extracted solids, e.g., sand.

Highly water soluble salts that are not hydrolyzing and useful in practicing processes of the present disclosure include salts having a monovalent cation, e.g., alkali halide salts such as sodium chloride, potassium chloride; also salts with monovalent cations such as sodium nitrate, potassium nitrate, sodium and potassium phosphates, sodium and potassium sulfates, etc. are useful in practicing processes of the present disclosure. Other monovalent cationic salts useful in practicing processes of the present disclosure include ammonium based salts such as ammonium acetate ($NH_4C_2H_3O_2$), ammonium chloride ($NH_4Cl$), ammonium bromide ($NH_4Br$), ammonium carbonate ($(NH_4)_2CO_3$), ammonium bicarbonate ($NH_4HCO_3$), ammonium nitrate ($NH_4NO_3$), ammonium sulfate ($(NH_4)_2SO_4$), ammonium hydrogen sulfate ($NH_4HSO_4$) ammonium dihydrogen phosphate ($NH_4H_2PO_4$), ammonium hydrogen phosphate ($(NH_4)_2HPO_4$), ammonium phosphate ($(NH_4)_3PO_4$), etc.

Ammonium based salts are useful for practicing the present disclosure since residual ammonium based salts that remain on the solids are not harmful to plant life and thus can more readily allow disposal of the solids such as in landfills. In fact, many of the ammonium based salts are useful as fertilizers and are in fact beneficial to plant life, e.g., ammonium chloride, ammonium nitrate, ammonium sulfate, etc. Many of the monovalent sulfate and phosphate salts are also useful as fertilizers. In certain embodiments of the present disclosure, the highly water soluble salt or salts used in the processes of the present disclosure can preferably be non-toxic and beneficial to plant life to aid in environmental remediation and the restoration of mine sites. Such highly water soluble salts include ammonium based salts and/or phosphate based salts.

Highly water soluble salts that can be used in practicing the present process can also include salts having multivalent cations. Such salts include, for example, divalent cation salts such as calcium and magnesium cation salts, such as calcium chloride ($CaCl_2$), calcium bromide ($CaBr_2$), calcium nitrate ($Ca(NO_3)_2$), magnesium chloride ($MgCl_2$), magnesium bromide ($MgBr_2$), magnesium nitrate ($Mg(NO_3)_2$), magnesium sulfate ($MgSO_4$); and trivalent cation salts such as aluminum and iron (III) cation salts, e.g., aluminum chloride ($AlCl_3$), aluminum nitrate ($Al(NO_3)_3$), aluminum sulfate ($Al_2(SO_4)_3$), iron (III) chloride ($FeCl_3$), iron (III) nitrate ($Fe(NO_3)_3$), iron (III) sulfate ($Fe_2(SO_4)_3$, etc. However, multivalent salts can increase fouling of containers and formation of less cohesive consolidated materials as compared to highly water soluble salts having monovalent cations. In addition, some multivalent salts, such as $FeCl_3$ and $Fe_2(SO_4)_3$, are particularly corrosive and $Fe_2(SO_4)_3$ is formed from oxidizing pyrite and results in acid mine run-off, which make such salts less preferable for use in processes of the present disclosure.

For a relatively short process times, the concentration of the at least one highly water soluble salt should preferably be at least 0.5 wt % and preferably no less than about 1 wt %, such as at least about 2 wt % and even at least about 3 wt %, 4 wt %, 5 wt %, 10 wt %, or higher in the aqueous mixture. When the composition to be treated includes a significant amount of water, the concentration of the highly water soluble salt in the aqueous separating mixture can be increased to account for the significant water in the composition.

The aqueous mixture used in separating hydrocarbon from compositions includes a water soluble polymer flocculent. Use of a water soluble polymer flocculent in the processes of the present disclosure can advantageously aid in aggregating solids in the treated composition and can also minimize formation of emulsions in the treated composition. Emulsions, also referred to as a rag layers, can form at the interface of a hydrocarbon and aqueous phase in treated compositions, it is believed that rag lays are stabilized by fine solids and certain hydrocarbons such as asphaltenes in hydrocarbon compositions. Such emulsions can be difficult to demulsify when formed.

Polymers that are useful in practicing aspect of the present disclosure include polyacrylamides or copolymers thereof such as nonionic poiyacrylamides, anionic polyacrylamides (APAM) and cationic polyacrylamides (CPAM) containing co-monomers such, as acryloxyethyltrimethyl ammonium chloride (DAC), methacryloxyethyltrimethyl ammonium chloride (DMC), dimethyldiallyammonium chloride (DMDAAC), etc. Other water soluble polymers such as polyethylene oxide and its copolymers, polymers based on modified starch and other polyelectrolytes such as polyamines and sulfonated polystyrenes can be used. The polymer flocculants can be synthesized in the form of a variety of molecular weights (MW), electric charge types and charge density to suit specific requirements.

The amount of polymer(s) used to treat hydrocarbon compositions should preferably be sufficient to flocculate solids in the composition. In some embodiments of the present disclosure, the concentration of the one or more polymer flocculant(s) in the aqueous separating mixture has a concentration of no less than about 0.001 wt %, e.g., no less than about 0.005 wt %. A relatively low amount of fines contained in the separated hydrocarbon can be obtained at polymer concentrations of no less than about 0.01 wt %, e.g., no less than about 0.04 wt %. When the composition to be treated includes a significant amount of water, the concentration of the polymer flocculent in the aqueous separating mixture can be increased to account for the significant water in the composition.

Processes of the present disclosure also include an organic diluent to treat the hydrocarbon composition to dilute the hydrocarbon and to promote separation and recovery of the hydrocarbon. Organic diluents useful for the processes of the present disclosure are soluble or mix readily with the hydrocarbon but are immiscible with water. Organic diluents useful for the processes of the present disclosure aid in diluting the hydrocarbon separated from the composition to reduce the viscosity thereof. Such organic diluents include, for example, aromatic hydrocarbons such as benzene, toluene, xylene, non aromatic hydrocarbons such as hexanes, cyclohexane, heptanes, mixtures of hydrocarbons such as naphtha, e.g., light or heavy naphtha, kerosene and paraffinic diluents, etc.

The processes of the present disclosure also can be practiced at relatively low temperatures. For example, hydrocarbon such as bitumen, and/or oil can be separated from the composition by treating the composition with an aqueous mixture including at least one highly water soluble salt, at least one polymer flocculent and an organic diluent at a temperature of less than 100° C., e.g., less than 50° C., and even less than 35° C., to separate the hydrocarbon from the composition. Alternatively, when the hydrocarbon composition includes a large amount of hydrocarbon, e.g., greater than 15 wt %, and/or if the hydrocarbon has a high viscosity, the processes of the present disclosure also can be practiced at elevated temperatures to lower the viscosity of the hydrocarbon being separated and aid in the separation. The treating temperature can be raised by any heating techniques including electric heating, electromagnetic heating, microwave heating, etc.

Treating compositions including hydrocarbon and solids with at least one highly water soluble salt, at least one polymer flocculent and at least one organic diluent can be carried out in a number of ways. In certain embodiments, treating the composition includes combining and/or mixing the various components. In addition, the water soluble salt can be added directly to the composition either as an undiluted powder or as a solution; the polymer flocculent can be added directly to the composition either as an undiluted material or as a solution, and the organic diluent can be added to the composition directly or with the salt and/or polymer or solutions thereof. The salt and polymer can be combined in a single aqueous solution, and combined or mixed with the composition before, during or after combining or mixing the organic diluent.

However, it tends to be more convenient to first prepare one or more solutions including the one or more highly water soluble salt(s) and the one or more polymer flocculent(s) followed by combining the one or more solutions with the composition, it was further found that mixing an aqueous solution of the salt(s) and polymer flocculent(s) with the hydrocarbon composition followed by mixing the organic diluent was more effective in separating the hydrocarbon from the composition under certain operations.

The process of the present disclosure allows for large scale treatment of hydrocarbon compositions in a continuous or semi-continuous process. For example, treating the composition can include mixing or combining a stream of the composition with a stream of an aqueous solution including the at least one highly water soluble salt and the at least one polymer flocculent and mixing or combining the streams with a stream of the organic diluent. The combination of streams separates the hydrocarbon from the composition, which can be recovered. In addition, after treating the composition, the aqueous solution can advantageously include a significant amount of the one or more highly water soluble salt(s) and at least a portion thereof can be recovered and recycled to treat additional hydrocarbon compositions.

The processes of the present disclosure can be implemented in variety of hydrocarbon compositions. For example, the process of the present disclosure can be applied to oil sands such as Canadian oil sands. Oil sands are a loose sand deposit which include bitumen, solids and water. Oil sands can be found all over the world and are sometimes referred to as tar sands or bituminous sands. Alberta Canada's oil sands include, on average, about 10-15 wt % bitumen, about 80 wt % solids and about 5 wt % water.

Although the process of the present disclosure has been described for treating hydrocarbon compositions which typically have hydrocarbon contents below about 15%, the process of the present disclosure can also be applied to mixtures including higher hydrocarbon contents, such as mixtures including over 15%, 20% 30%, 40%, 50% and higher hydrocarbon contents. Such compositions can also optionally include a significant amount of water. For example, the process of the present disclosure can be applied to bitumen froth which typically contains over 40% hydrocarbon by weight, e.g., certain bitumen froth can include about 50%-60% bitumen, 30%-40% water and about 10%-14% solids, mostly as fines.

The process of the present disclosure can also be applied to pitch materials such as pitch materials from natural deposits. For example, natural deposits of Pitch Lake materials are a mixture of bitumen, minerals, water, decayed vegetation. Such materials can include greater than about 50% bitumen, as high as 30% fines (mainly in the form of clays) and about 10% water as an emulsion in the composition. The emulsified nature of the bitumen/water/minerals of such hydrocarbon compositions makes extraction of bitumen by conventional methods challenging.

Implementing processes of the present disclosure includes treating a hydrocarbon composition including a significant amount by weight of fines (>5%). The compositions can include, for example, oil sands, Canadian oil sands, bitumen froth, or hydrocarbon containing by products of oil sands production, asphalt compositions and pitch materials and other natural and non-natural asphalt containing compositions, hydrocarbon contaminated solids such as hydrocarbon contaminated rock, soil, hydrocarbon waste products containing inorganic solids such as oily sludge, etc. Such compositions can be treated with an aqueous mixture including at least one highly water soluble salt, at least one polymer flocculent, and at least one organic diluent to separate the hydrocarbon from the composition. Advantageously, the hydrocarbon separated from the composition can contain a low amount of fines and/or minerals, e.g., less than about 1 wt % or no more than about 0.5 wt % or no more than about 0.1 wt %.

EXAMPLES

The following examples are intended to further illustrate certain preferred embodiments of the invention and are not limiting in nature. Those skilled in the art will recognize, or be able to ascertain, using no more than routine experimentation, numerous equivalents to the specific substances and procedures described herein.

Treatment of Kentucky Oil Sands to Separate Hydrocarbon Therefrom

For this experiment, a sample of oil sands from Kentucky, USA is simply mixed with a 10% solution of ammonium chloride, which also contains 0.1% of nonionic polyacrylamide (available from either Sigma Aldrich or SNF Co. and having a molecular weight of over 4 million). The polymer acts in concert with the salt solution to sequester clays and minimize emulsion formation. A heavy naphtha (obtained from Sherwin Williams (VM&P naphtha)) was also added to lower the viscosity of the bitumen and allow a separation at room temperature. The sample was mixed with a laboratory magnetic stirrer for 5 minutes and allowed to stand for less than one minute. The proportions of oil sands to salt solution to naphtha were 1:1:1 by weight in this illustrative example to allow a clear visualization of the process. Other proportions can be used depending on the nature of the particulate matter being extracted and the demands of the separation.

FIG. 1 is a picture of the vial showing extraction of bitumen from the oil sands with the treating mixture. Upon standing for a few minutes, a clear separation into three phases can be observed. At the bottom of the vial is the extracted sand. Between the sand and the naphtha diluted bitumen (oil) is a layer of salt solution. This layer appears optically clear. In conventional water based processes of extracting oil sands, the aqueous layer is usually cloudy because of the presence of fines and ultrafine mainly clay particles. Fines and ultrafine particles have a surface charge that severely hinders aggregation and settling of these particles. It is believed the salt solution screens these repulsive charges, facilitating aggregation. The polymer enhances aggregation and settling by binding together fines and coarse particles, which then become part of the bottom residual sands layer.

Figure 2:
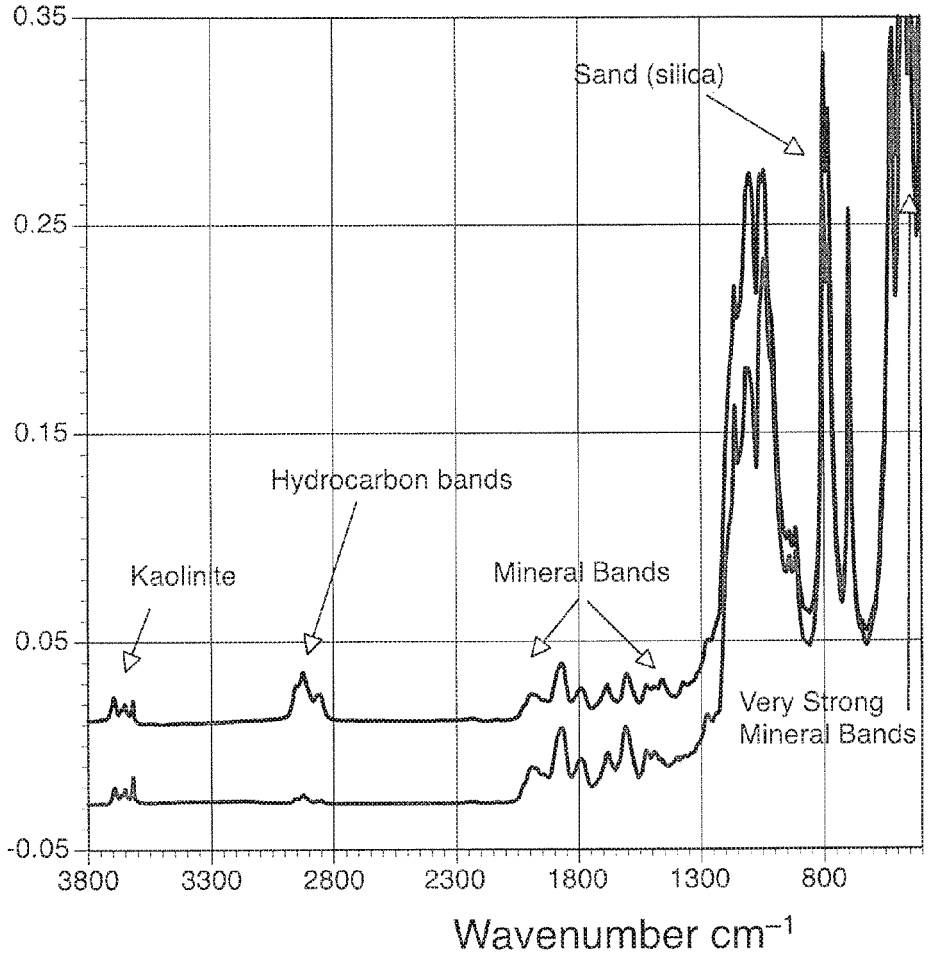
FIG. 2 is a comparison of the infrared spectra of an original Kentucky oil sands sample to the extracted residual mineral matter.

In this simple one-stage extraction, about 87% of the bitumen was removed from the oil sands. The amount of bitumen removed is illustrated by the infrared spectrum of the original oil sands shown in FIG. 2, where it is compared to the spectrum of the extracted sand. In this analytical technique, infrared light is absorbed (or scattered) at particular frequencies (usually reported as wavenumbers, $cm^{-1}$) according to the types of chemical groups present. The height of the absorption peaks is proportional to the amount of those groups present. The spectrum of the oil sands is thus a composite of bands from the oil and bands from the minerals, as shown in the top curve in FIG. 2. Minerals absorb far more strongly in the infrared than simple hydrocarbons and bands due to silica and clays dominate the spectrum at wavenumbers ($cm^{-1}$) lower than 2300 $cm^{-1}$. The only bands due to hydrocarbons that can be seen are between 2800 and 3000 $cm^{-1}$, as this is a region of the spectrum where there are no mineral bands.

Using straight solvent extraction, we determined that the oil content in this particular sample was only about 8%, as it was taken from the edge of a pile that had been stored in the open for a period of years. All the light oil fractions had evaporated, leaving the heavier end with an excess of asphaltenes that can be problematic in separations, especially using a non-aromatic diluent like the naphtha used in this experiment. Nevertheless, the spectrum of the extracted sand showed only very weak hydrocarbon absorptions (bottom curve in FIG. 2). By ratioing the intensity of the hydrocarbon band near 2920 $cm^{-1}$ to that of a mineral band near 1900 $cm^{-1}$, we estimated that 87% of the hydrocarbons had been extracted. More could be obtained using a better diluent or solvent for heavy oil (e.g., xylene), by extracting at higher temperatures, or by performing two successive extractions with naphtha.

Figure 3:
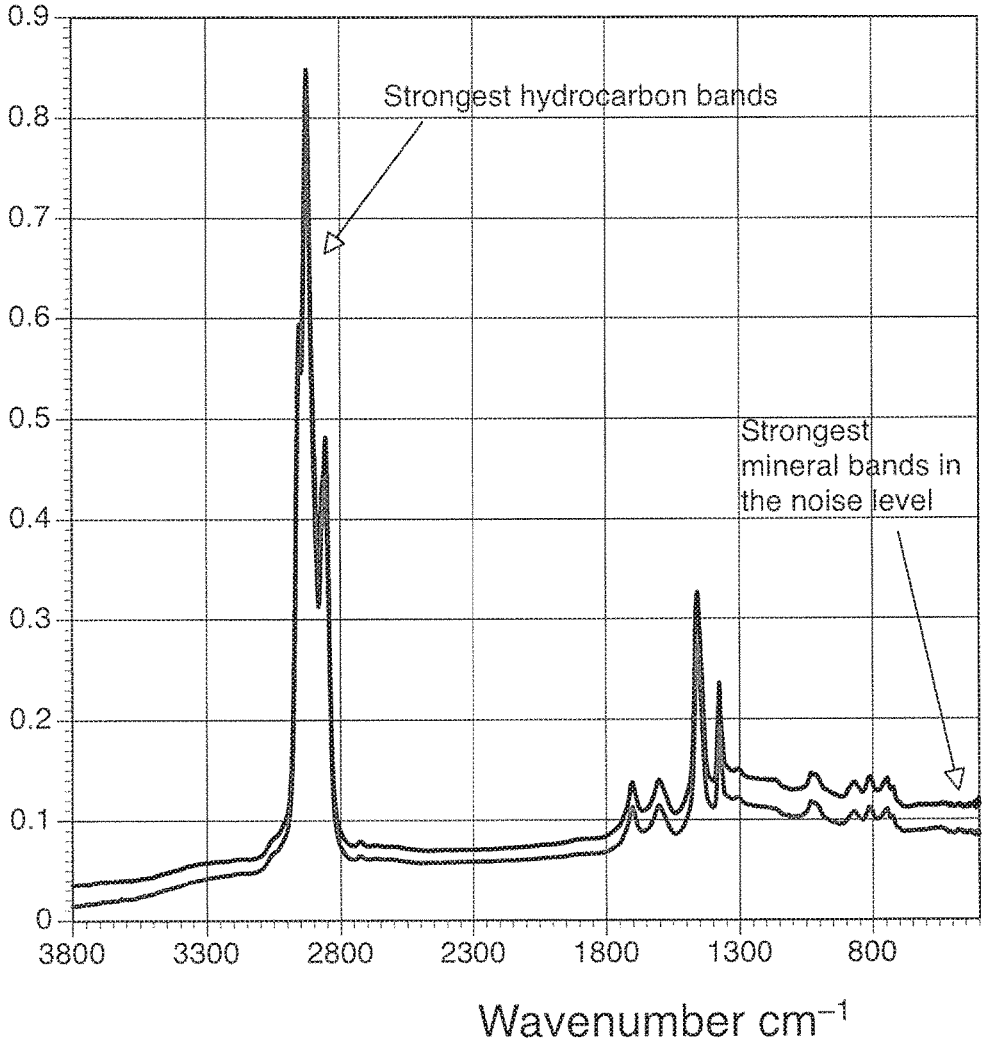
FIG. 3 shows infrared spectra of two films of bitumen separated from Kentucky oil sands by a separating mixture according to an embodiment of the present disclosure.

Spectra of the extracted bitumen (after removal of the naphtha) are shown in FIG. 3. Referring back to FIG. 2, the strongest mineral bands are at the right hand end of the plot, near 500 $cm^{-1}$. They are in fact, off the scale of in FIG. 2. In the spectra of two cast films of the bitumen, any bands in this region are essentially in the noise level of the plot, showing that bitumen with a mineral content of well under 1% has been obtained.

Comparative Treatments of Kentucky Oil Sands

Figure 4:
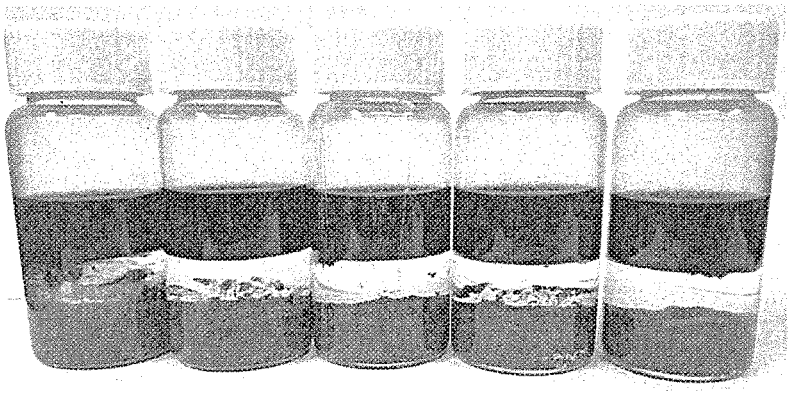
FIG. 4 is a picture of vials containing Kentucky oil sands that were treated in various ways.

For this experiment, samples of oil sands from Kentucky, USA were treated with naphtha and either water without salt ("water alone") or an aqueous solution of a highly water soluble salt (ammonium chloride or sodium chloride) containing a water soluble polymer. Two concentrations of ammonium chloride and sodium chloride solutions (10% and 25%) containing 0.1% polymer (polyacrylamide PAM) were used to treat the samples. As shown in FIG. 4, good separations were obtained with all of the salt solutions, but with water alone, a cloudy suspension was observed and there was a significant rag layer between the hydrocarbon phase on the top and the water layer beneath (middle layer above the minerals). In addition, the oil phase in the water alone vial appeared to include trapped minerals, probably fines.

Treatment of Canadian Oil Sands to Separate Hydrocarbon Therefrom

Figure 5:
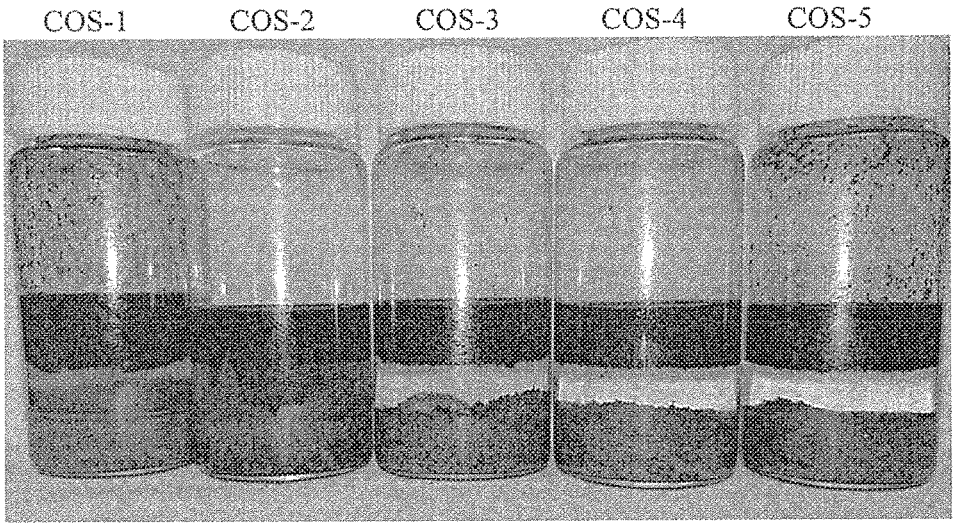
FIG. 5 is a picture of vials containing Canadian oil sands that were treated in various ways.

In developing a large-scale process, material costs (mainly salt and polymer) should be minimized. In addition, high concentrations of salts can lead to problems with corrosion. A set of experiments aimed at minimizing salt and polymer use were therefore conducted. The results are shown in FIG. 5. Canadian oil sands (obtained from Alberta Innovates of Alberta, Canada) which included about 11% bitumen were used for these experiments. The Canadian oil sands were mixed with various aqueous solutions and naphtha in the proportions 1:1:1 by weight. These proportions allow a clear visualization of the separation, but in practice other proportions can be used. In these experiments, aqueous ammonium sulfate solutions containing 1% ammonium sulfate by weight were employed together with various concentrations of polymer (PAM). The components were mixed and separated under gravity.

A 1% salt solution alone was used in the vial on the far left (COS-1), while next to this an aqueous solution of PAM alone (0.1% by weight) was used (COS-2), as controls. A clean separation of the components into three layers, extracted sand at the bottom, aqueous solution in the middle and solvent diluted bitumen at the top was not obtained with a 1% salt solution alone (COS-1). There was a significant rag layer between the liquid phases and the salt solution (middle layer) was a little cloudy as a result of the presence of some suspended particles. The rag layer is an emulsion containing solvent-diluted bitumen, aqueous solution and minerals fines, mainly clays. The second control vial, which used an aqueous solution of polymer alone (0.1%) (COS-2), gave even worse results, with a very cloudy middle layer and also a significant rag layer.

The remaining three vials show the results of using 1% salt ammonium sulfate solutions with 0.1% PAM, 0.05% PAM and 0.01% PAM, from left-to-right (COS-3, COS-4, COS-5, respectively). With 0.1% PAM, the middle aqueous layer is still slightly cloudy, but the rag layer is considerably diminished. The vials containing 0.05% PAM and 0.01% PAM (COS-4 and COS-5) had a clear middle layer and only a small rag layer that was difficult to separate and quantify with any accuracy. Infrared spectra of the extracted samples showed that the best results were obtained with the 1% salt, 0.01% polymer solutions. The amount of residual hydrocarbons on the sand was minimized, while the extracted bitumen contained no detectable minerals.

Figure 6:
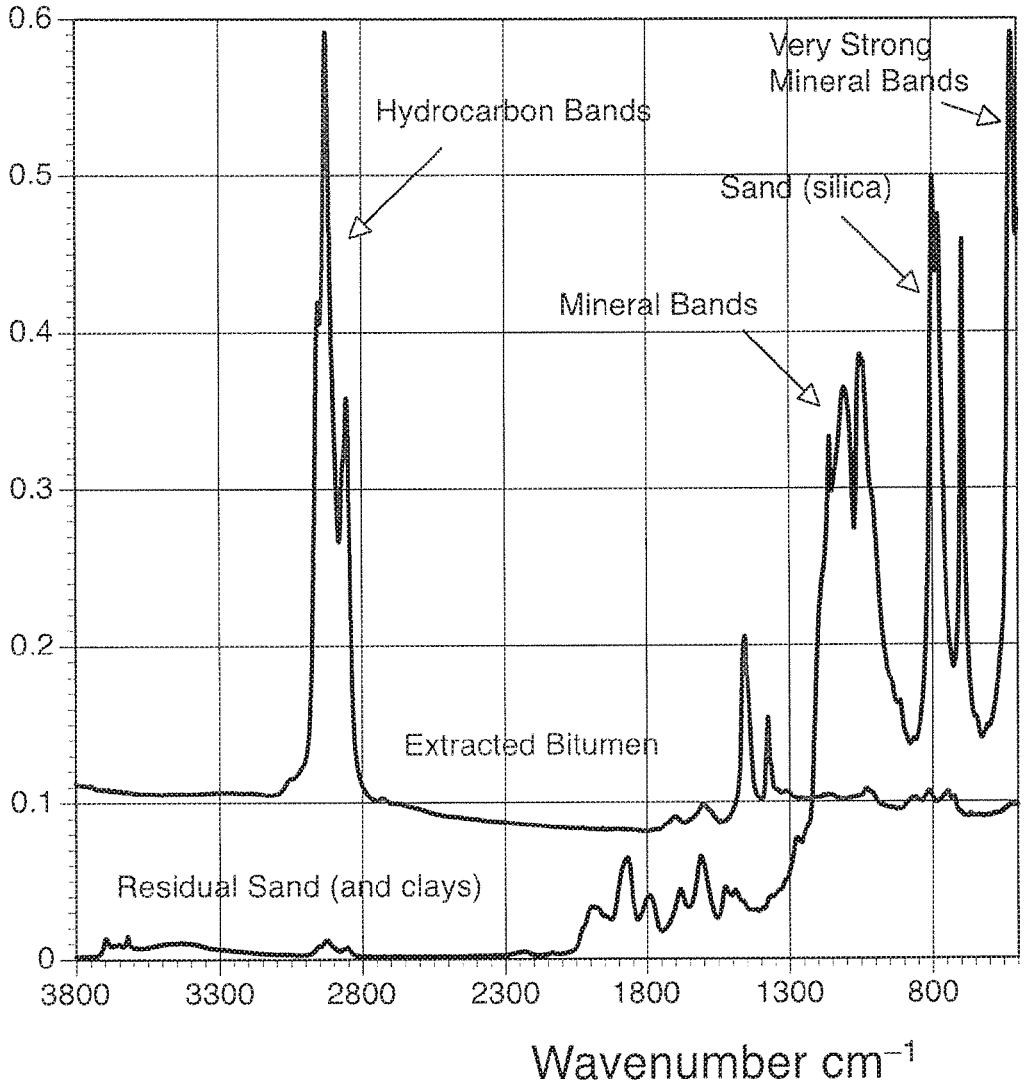
FIG. 6 shows infrared spectra comparing bitumen separated from Canadian oil sands to the extracted residual sand.

The infrared spectra of the extracted bitumen and residual sand are compared in FIG. 6. The most prominent hydrocarbon and mineral bands are marked on the figure. It can be seen that any mineral bands in the extracted bitumen are below the detection limit of the instrument (below about 0.1% by weight). There is a small amount of residual hydrocarbon on the sand, comparable to what was observed with the Kentucky sample.

Figure 7:
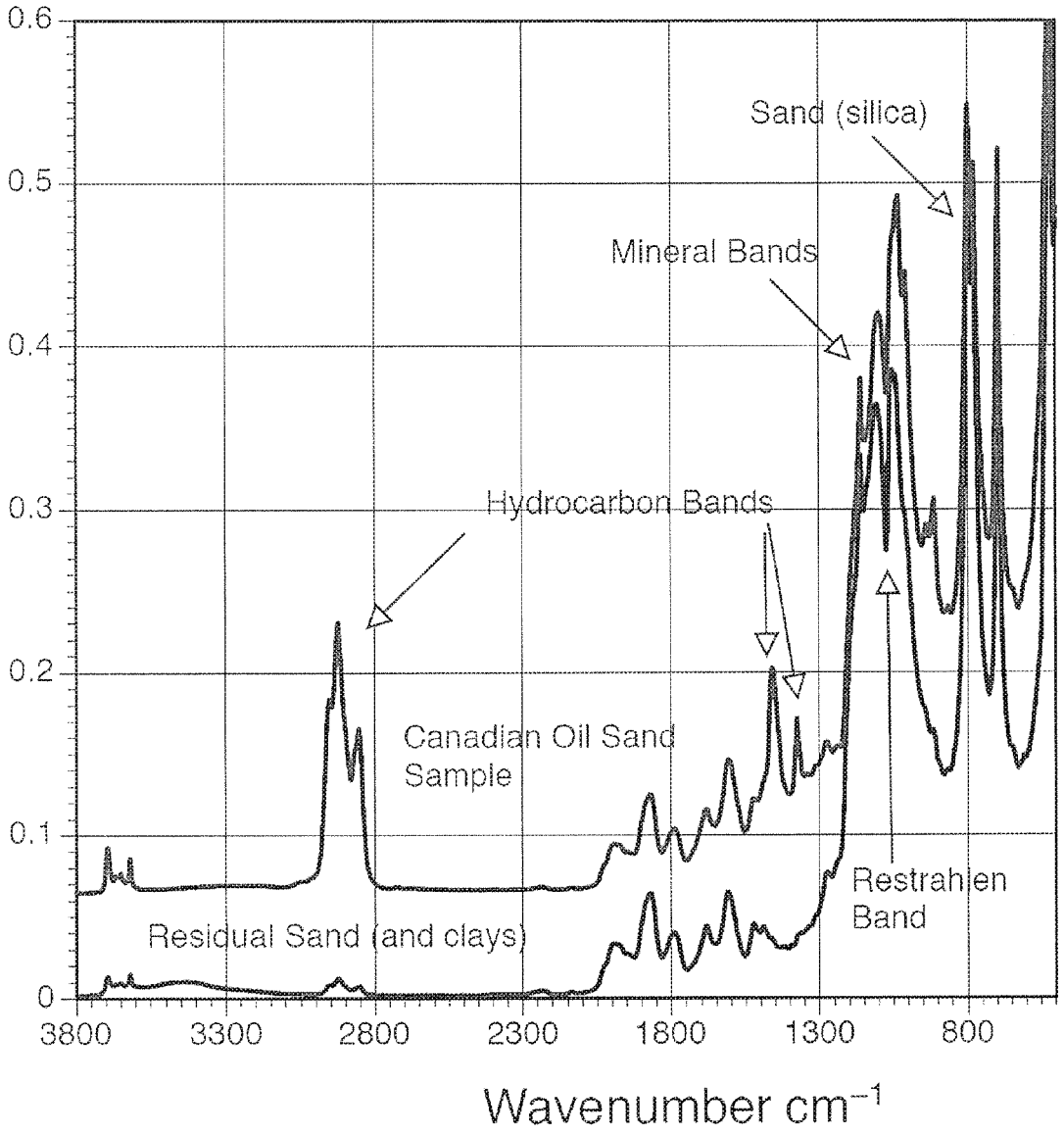
FIG. 7 shows infrared spectra comparing an original Canadian oil sands sample to the extracted residual sand.

In this simple one-stage extraction about 87% of the bitumen was removed from the Canadian oil sands. This is illustrated by the infrared spectrum of the original oil sands shown in FIG. 7 (top curve), where it is compared to the spectrum of the extracted sand (bottom curve). More hydrocarbon could be obtained using a better diluent or solvent for heavy oil (e.g., xylene), by extracting at higher temperatures, or by performing two or more successive extractions with a diluent or solvent for the hydrocarbon.

Large Scale Treatment of Kentucky Oil Sands to Separate Hydrocarbon

Large scale extraction of bitumen from Kentucky oil sands were successfully accomplished using a salt-polymer solution in a pilot unit. A solution of a highly water soluble salt (ammonium sulfate) and polymer (polyacrylamide) was initially prepared. The concentration of the ammonium sulfate in the solution was 10% and the concentration of polyacrylamide in the solution was 0.1% (by weight). Approximately 100 lbs (45.4 kg) or 150 lbs (68 kg) of Kentucky oil sands were treated with the solution. The oils sands were treated by mixing the oil sands with the ammonium sulfate/polyacrylamide solution followed by addition of naphtha with further mixing. The relative proportion of oil sands to salt/polymer solution to naphtha was 1:1:0.5 by weight.

In vial tests, a double extraction was used to obtain better than 90% of the bitumen. The small pilot unit gave somewhat better results, in part, because larger centrifuges exerting higher g-forces were used. The pilot unit included a mixing vessel, a decanting centrifuge and a stack centrifuge. The oil sands were mixed for about 10 minutes with the salt/polymer solution and naphtha, then pumped to the decanting centrifuge, where the bulk of the solids were separated from the liquids. The liquids, containing a small amount of mineral fines, are then pumped to the stack centrifuge where the immiscible salt/polymer solution (plus fines) are separated from the hydrocarbons/naphtha diluted bitumen. During separation, an initially mixed product was obtained in the first minutes of operation, but equilibrium in separation was quickly achieved and a good separation achieved.

Figure 8:
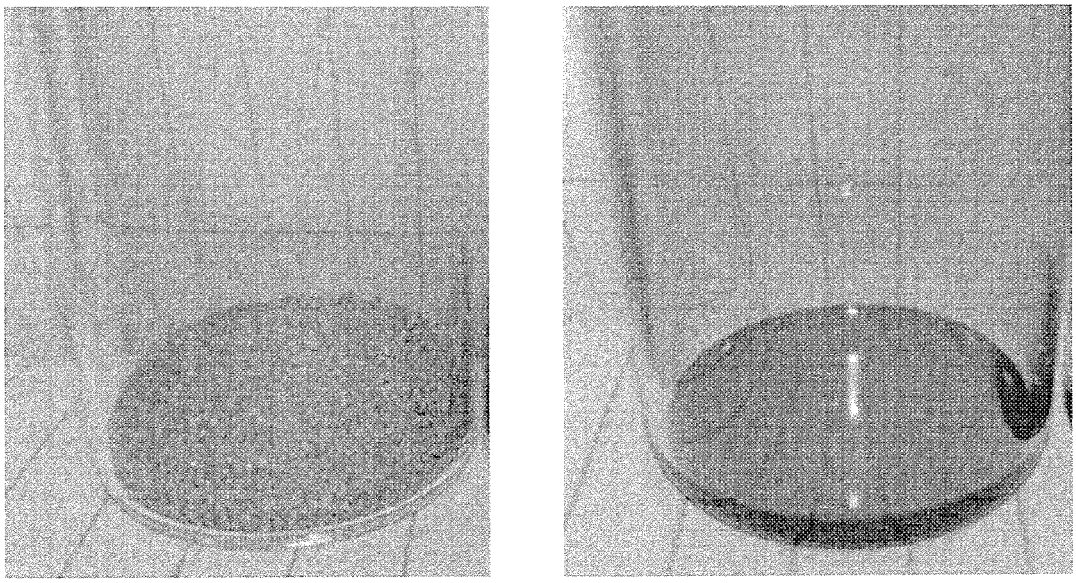
FIG. 8 shows pictures of vials containing samples of (left) extracted mineral matter and (right) recovered bitumen from Kentucky oil sands.
Figure 9:
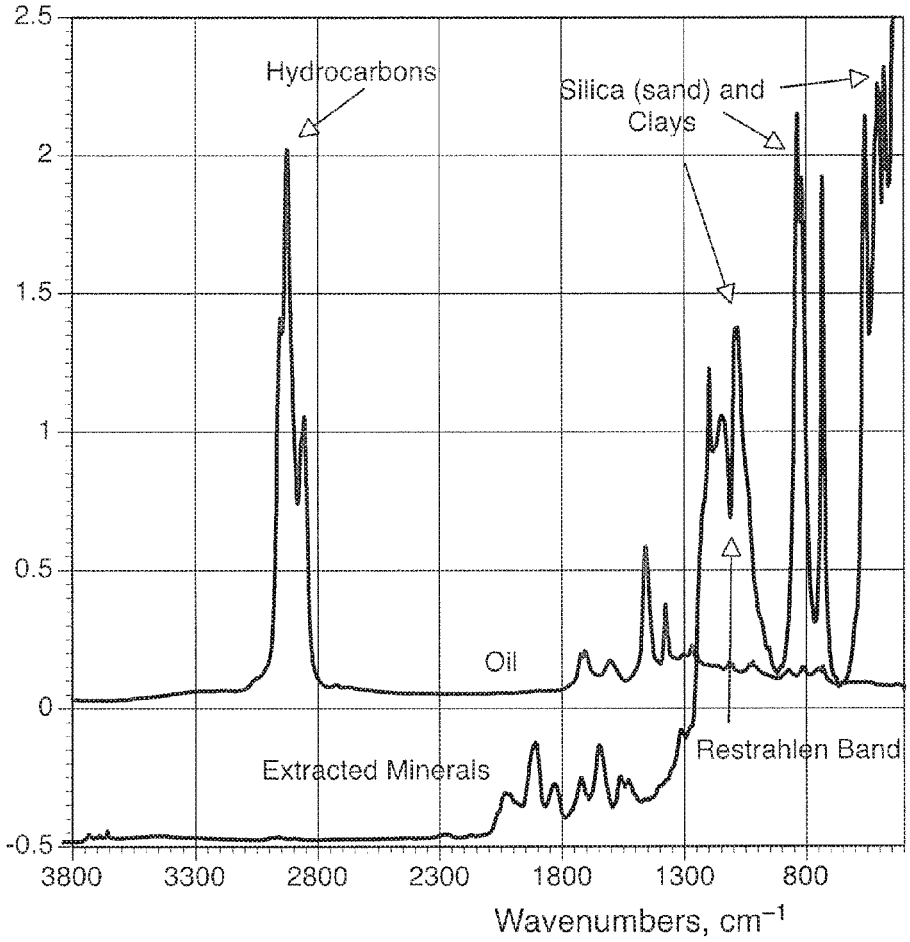
FIG. 9 shows infrared spectra comparing bitumen separated from Kentucky oil sands to the extracted residual mineral matter.

A picture of vials containing the recovered minerals is shown in FIG. 8. Visually, the recovered minerals (mainly sand and clays) appear clean and the recovered bitumen appears free of minerals and emulsified water. This was confirmed by infrared spectroscopy. The spectra of the residual minerals and bitumen, shown in FIG. 9, show that hydrocarbon bands (near 2900 $cm^{-1}$) were in the noise level of the baseline in the spectrum of the extracted mineral matter. Similarly, mineral bands in the spectrum of the recovered bitumen are beneath the detection limit. The strongest mineral bands are in the 600 $cm^{-1}$-400 $cm^{-1}$ range and are again in the noise level of the baseline. It can be seen that any mineral bands in the extracted bitumen are below the detection limit of the instrument (below about 0.1% by weight).

Only the preferred embodiment of the present invention and examples of its versatility are shown and described in the present disclosure. It is to be understood that the present invention is capable of use in various other combinations and environments and is capable of changes or modifications within the scope of the inventive concept as expressed herein. Thus, for example, those skilled in the art will recognize, or be able to ascertain, using no more than routine experimentation, numerous equivalents to the specific substances, procedures and arrangements described herein. Such equivalents are considered to be within the scope of this invention, and are covered by the following claims.

What is claimed is:

1. A process for separating hydrocarbon from a composition comprising hydrocarbon and solids, the process comprises treating the composition with an aqueous mixture including at least one highly water soluble salt, at least one polymer flocculent and at least one organic diluent to separate the hydrocarbon from the composition;

wherein the treated composition has a salt-composition concentration of the at least one highly water soluble salt of no less than about 1 wt %.

2. The process of claim 1, further comprising recovering the separated hydrocarbon from the treated composition.

3. The process of claim 1, wherein the composition is oil sands, bitumen froth, hydrocarbon containing by products of oil sands processing, asphalt compositions, pitch materials, hydrocarbon contaminated solids, or hydrocarbon waste products.

4. The process of claim 1, wherein the composition includes a significant amount by weight of fines and the separated hydrocarbon obtained directly from separating the composition from the aqueous mixture has less than 1 wt % of fines.

5. The process of claim 1, wherein the at least one highly water soluble salt is an ammonium based salt.

6. The process of claim 1, wherein the at least one highly water soluble salt is ammonium chloride, ammonium sulfate or combinations thereof.

7. The process of claim 1, wherein the treated composition has a salt-composition concentration of the at least one highly water soluble salt of at least about 2 wt %.

8. The process of claim 1, wherein the at least one polymer flocculent is a polyacrylamide or co-polymer thereof.

9. The process of claim 1, wherein the treated composition has a polymer-composition concentration of the at least one polymer flocculent of no less than about 0.005 wt %.

10. The process of claim 1, wherein treating the composition includes combining the composition with an aqueous solution including the at least one highly water soluble salt and the at least one polymer flocculent and mixing the combination with the organic diluent.

11. The process of claim 1, wherein at least 80% of the hydrocarbon is separated from the composition.

12. The process of claim 1, further comprising recovering and recycling at least a portion of the at least one highly water soluble salt to treat additional compositions comprising hydrocarbon and solids.

13. A process for separating hydrocarbon from a composition comprising hydrocarbon and solids, the process comprises: treating a composition of oil sands, bitumen froth, and/or a hydrocarbon containing by product of oil sands processing with an aqueous mixture including at least one highly water soluble salt, at least one polymer flocculent and an organic diluent to separate the hydrocarbon from the composition; and recovering the separated hydrocarbon;

wherein the at least one highly water soluble salt comprises an alkali halide salt and the treated composition has a salt-composition concentration of the alkali halide salt of no less than about 1 wt %.

14. The process of claim 13, further comprising recovering and recycling at least a portion of the alkali halide salt to treat additional compositions comprising hydrocarbon and solids.

15. The process of claim 13, wherein the aqueous mixture separates at least 85% of the hydrocarbon from the composition.

16. A process for separating bitumen or oil from oil sands, the process comprising:

contacting oil sands comprising bitumen or oil with a mixture including a highly water soluble ammonium based salt and a water soluble polymer in an aqueous solution to separate the bitumen or oil from the oil sands; and recovering the separated bitumen or oil;

wherein the mixture has a concentration of the ammonium based salt of no less than about 1 wt %.

17. The process of claim 16, wherein the ammonium based salt is ammonium chloride, ammonium sulfate or combinations thereof.

18. The process of claim 16, further comprising adding an organic diluent to the oil sands or mixture which can dilute the bitumen or oil.

19. The process of claim 16, further comprising recovering and recycling at least a portion of the ammonium based salt to treat additional oil sands.

20. The process of claim 16, wherein the mixture has a concentration of the ammonium salt of at least about 2 wt % and a concentration of the water soluble polymer of no less than about 0.005 wt %.

* * * * *